US006321937B1

(12) United States Patent
DeSimone et al.

(10) Patent No.: US 6,321,937 B1
(45) Date of Patent: Nov. 27, 2001

(54) AEROSOL DISPENSING SYSTEM WITH ON-BOARD WIPER DISPENSER

(75) Inventors: Ronald F. DeSimone, Kildeer; Richard Messina, Chicago, both of IL (US); Charles L. Williams, Evansville, IN (US)

(73) Assignee: Chase Products Company, Broadview, IL (US)

( * ) Notice: Subject to any disclaimer, the term of this patent is extended or adjusted under 35 U.S.C. 154(b) by 0 days.

(21) Appl. No.: 09/373,689

(22) Filed: Aug. 13, 1999

(51) Int. Cl.[7] ..... A47K 10/24; B65H 1/00

(52) U.S. Cl. ..... 221/445; 401/10; 401/124; 222/192; 222/321.7

(58) Field of Search ..... 221/45; 206/5.1; 401/10, 124, 208; 222/192, 321.7, 321.9

(56) References Cited

U.S. PATENT DOCUMENTS

| | | | | |
|---|---|---|---|---|
| 1,879,517 | * | 9/1932 | Rowbotham | 206/5.1 |
| 2,292,413 | * | 8/1942 | Taylor | 206/5.1 |
| 4,436,224 | * | 3/1984 | McInerny | 222/192 X |
| 4,522,298 | * | 6/1985 | Weinberger | 206/216 X |
| 4,524,871 | | 6/1985 | Klinger . | |
| 4,651,890 | * | 3/1987 | Coker et al. | 220/85 R |
| 4,667,846 | * | 5/1987 | Marceau | 221/34 X |
| 4,735,317 | | 4/1988 | Sussman et al. . | |
| 4,927,284 | | 5/1990 | Tsai . | |
| 4,964,543 | * | 10/1990 | Scheiber | 222/192 X |
| 5,035,321 | | 7/1991 | Denton . | |
| 5,269,615 | * | 12/1993 | Lewis, Jr. | 401/10 X |
| 5,439,104 | * | 8/1995 | Wolska-Klis | 206/233 X |
| 5,480,060 | * | 1/1996 | Blythe | 221/45 X |
| 5,671,872 | * | 9/1997 | Daniels, Jr. | 222/192 X |
| 5,749,460 | | 5/1998 | Rice . | |
| 5,769,263 | | 6/1998 | Willingham et al. . | |
| 5,803,249 | | 9/1998 | Harsanyi, Jr. et al. . | |
| 5,819,989 | * | 10/1998 | Saraceni | 222/192 X |
| 5,887,759 | * | 3/1999 | Ayigbe | 222/192 X |
| 5,988,910 | * | 11/1999 | Yahav | 401/10 X |

* cited by examiner

*Primary Examiner*—Donald P. Walsh
*Assistant Examiner*—Gene O. Crawford
(74) *Attorney, Agent, or Firm*—Jenner & Block, LLC

(57) ABSTRACT

An aerosol dispensing system includes an aerosol can and a wiper dispenser removably attached to the can. A cup containing absorbent material, such as a roll of toweletes, is snap fit to the bottom of the can. The cup may be removed to dispense wipers and replaced on the can for storage. The wiper dispenser may be refilled with a replacement roll of towelettes.

8 Claims, 4 Drawing Sheets

FIG. 4
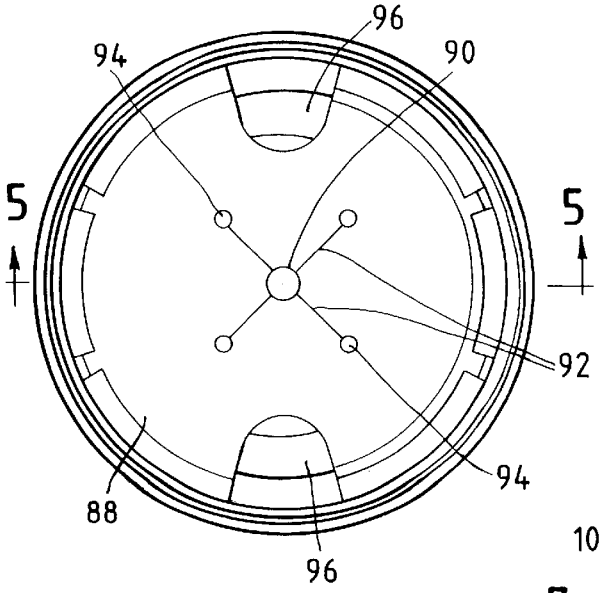
FIG. 7
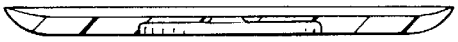
FIG. 6
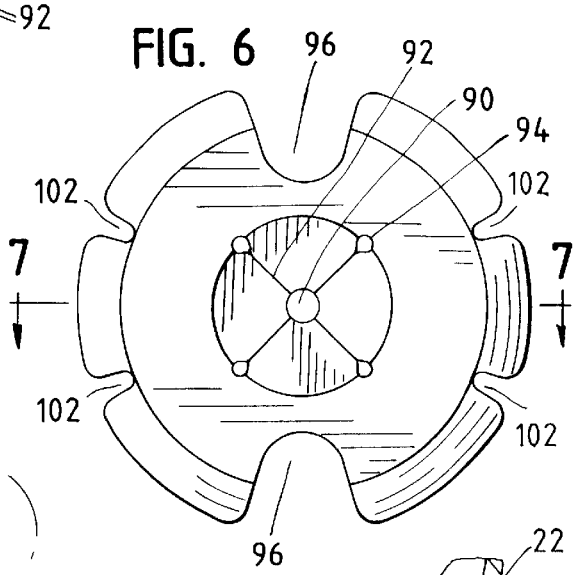
FIG. 5
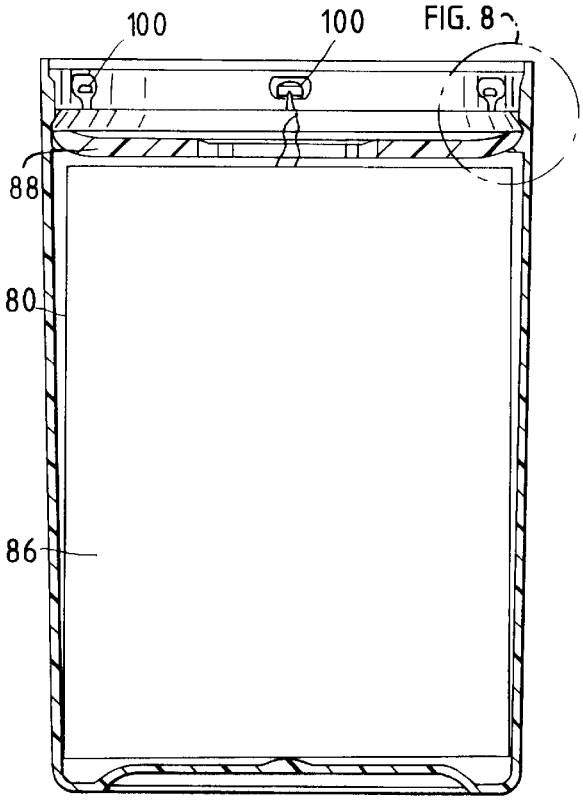
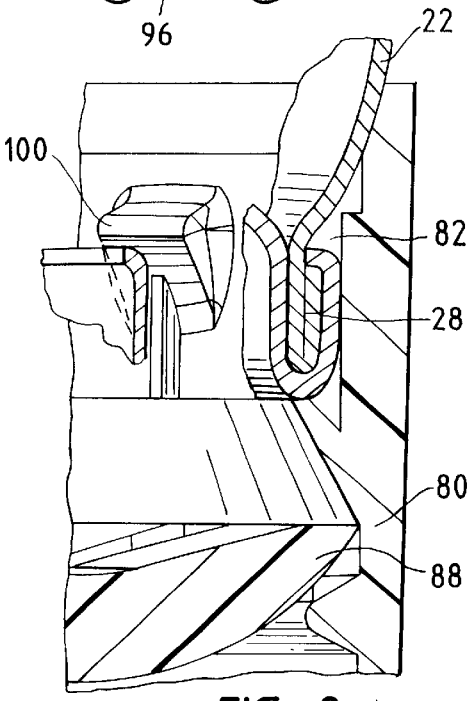
FIG. 8

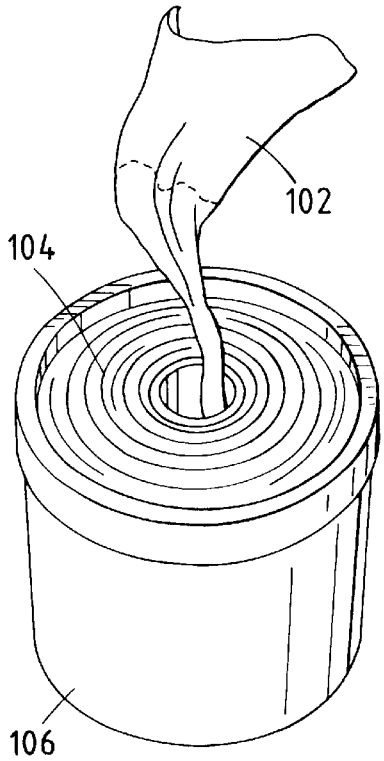
FIG. 9
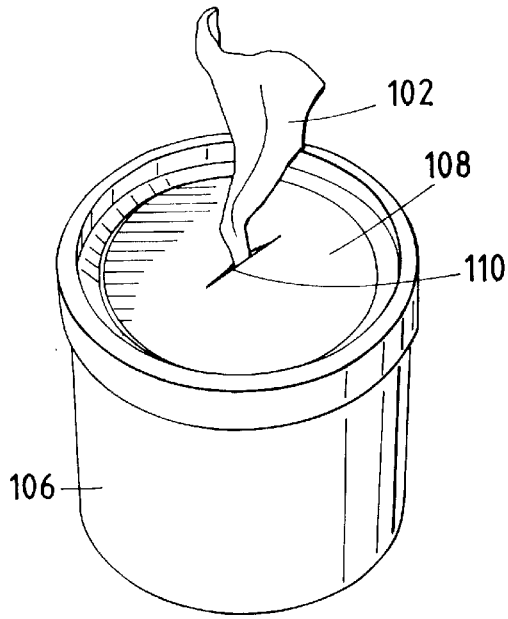
FIG. 10
FIG. 11
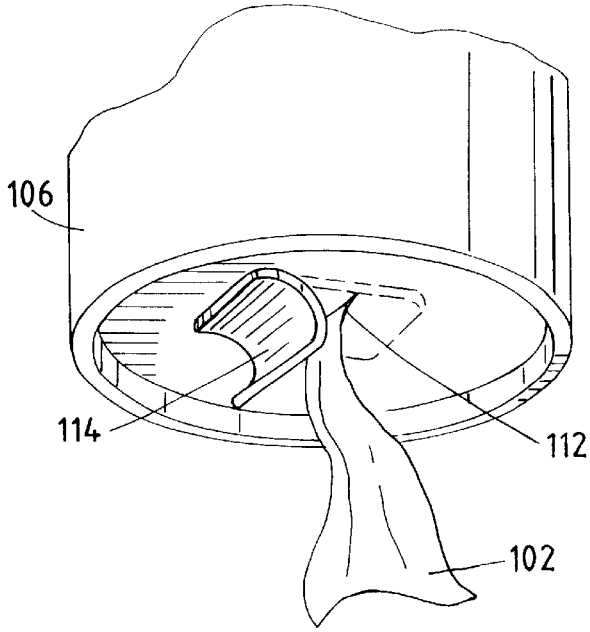

AEROSOL DISPENSING SYSTEM WITH ON-BOARD WIPER DISPENSER

FIELD OF THE INVENTION

This invention relates to an aerosol dispensing system having a pressurized container which stores propellant and concentrate with an on-board wiper dispenser, and more particularly to an aerosol can which includes a on-board towel dispenser.

BACKGROUND OF THE INVENTION

Aerosol dispensing systems typically consist of a cylindrical metal container which stores a concentrate and propellant which are under pressure. A plastic spray dome covers and activates a valve to initiate the flow of concentrate and propellant which mix and disburse in an aerosol spray. Such aerosol dispensers can conveniently and safely disburse a variety of chemical compositions including paint, insecticide, and lubricants. Aerosol dispensers, especially aerosol cans, are also commonly used for applications such as cleaning chemicals, in which the user needs a paper towel, cloth wipe or other absorbent material to wipe the cleaned surface or wipe up any excess of the material being dispensed. It may often be inconvenient to carry a separate towel holder in addition to the aerosol can. As a result, some users stuff paper towels in a pocket of their clothing, but the towels can become intertwined and difficult to separate. Cleaning supply caddies can be used to carry one or more aerosol cans, a roll of paper towels and other items. An example of such a caddy is shown in U.S. Pat. No. 5,035,321. However, this approach requires the purchase of a caddy, and the user must carry the large caddy even if only one aerosol can and a few wipes are needed.

SUMMARY OF THE INVENTION

The present invention relates to aerosol dispensing systems which store concentrate and propellant under pressure and provide an on-board wiper dispenser, and which are designed so as to overcome the disadvantages of conventional aerosol dispensers. The invention has particular utility with metal aerosol cans which contain cleaning products.

More particularly, the present invention includes a cup which is removably attached to the bottom of the aerosol can. The cup contains an absorbent wiper such as paper towels.

The advantages of the invention are adaptable to pressurized aerosol dispensing systems without adversely impacting the printing area for the can. The dispensing system permits essentially the entire cylindrical container to contain printing and graphic information such as product information and advertising, and creates a commercially attractive aerosol dispensing system.

One object of the present invention is to provide an aerosol dispensing system having readily available absorbent wiping materials.

Another object is to provide aerosol dispensers particularly useful for industrial applications and consumer applications involving cleaning chemicals in which users may need to wipe up excess sprayed material using a paper towel or other absorbent wiper.

Another object of the invention is to provide convenient means for replenishing the supply of absorbent material without replacing the entire aerosol can.

Other objects and advantages of the present invention will be apparent from the following description with reference to the attached drawings.

BRIEF DESCRIPTION OF THE DRAWINGS

FIG. 4 is a top view of the removable wiper dispenser of the system of FIG. 1;

FIG. 5 is a cross-sectional side view of the wiper dispenser of FIG. 4;

FIG. 6 is a top view of the top cover of the wiper dispenser of FIG. 4;

FIG. 7 is a cross-sectional view of the cover of FIG. 6;

FIG. 8 is a detailed view showing the attachment of the cover to the dispenser and the snap-fit mechanism for attaching the wiper dispenser to the aerosol can;

FIG. 9 is a top perspective view of a second embodiment of a wiper dispenser;

FIG. 10 is a top perspective view of a third embodiment of a wiper dispenser; and FIG. 11 is a bottom perspective view of a fourth embodiment of a wiper dispenser.

DETAILED DESCRIPTION

Figure 1:
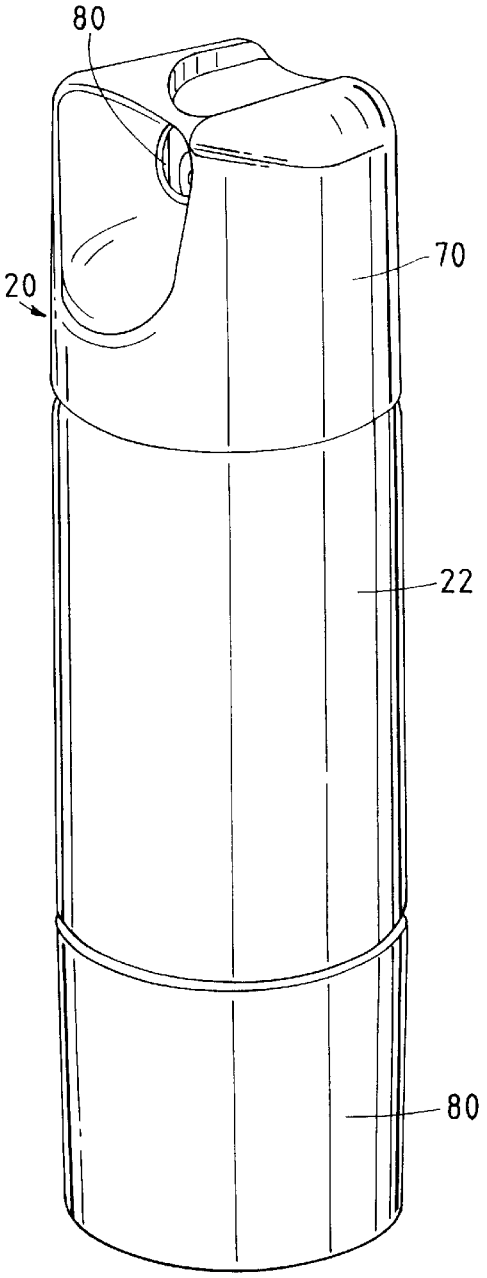
FIG. 1 shows a perspective view of a first embodiment of an aerosol dispensing system with an on-board wiper dispenser.
Figure 2:
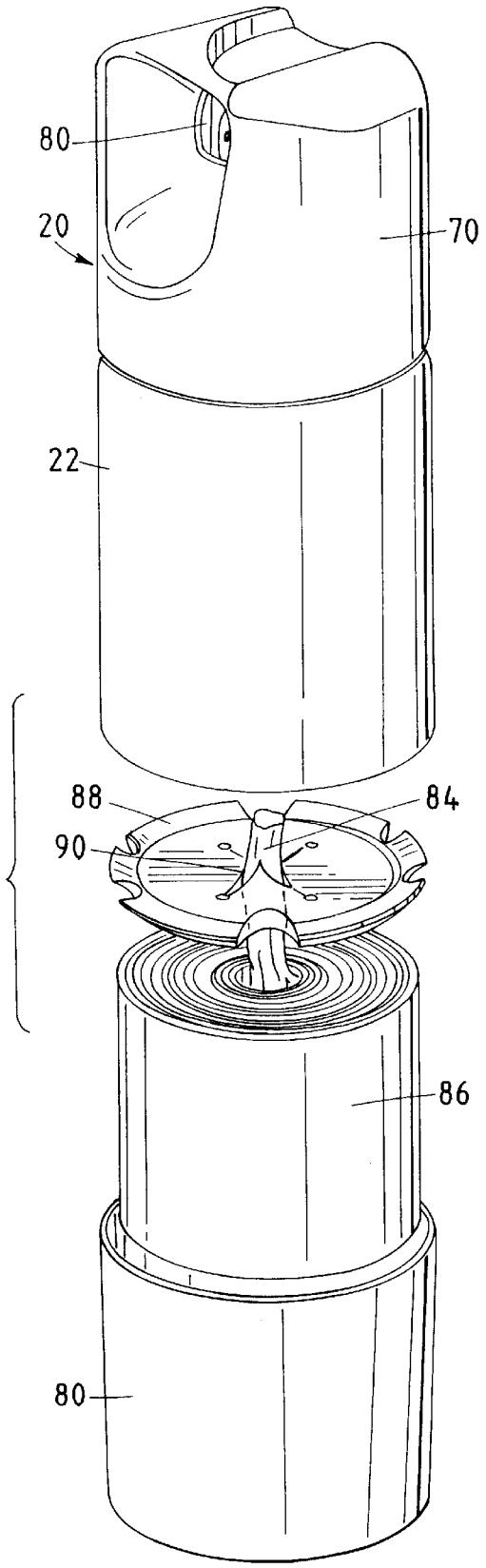
FIG. 2 shows an exploded perspective view of the aerosol dispensing system of FIG. 1.
Figure 3:
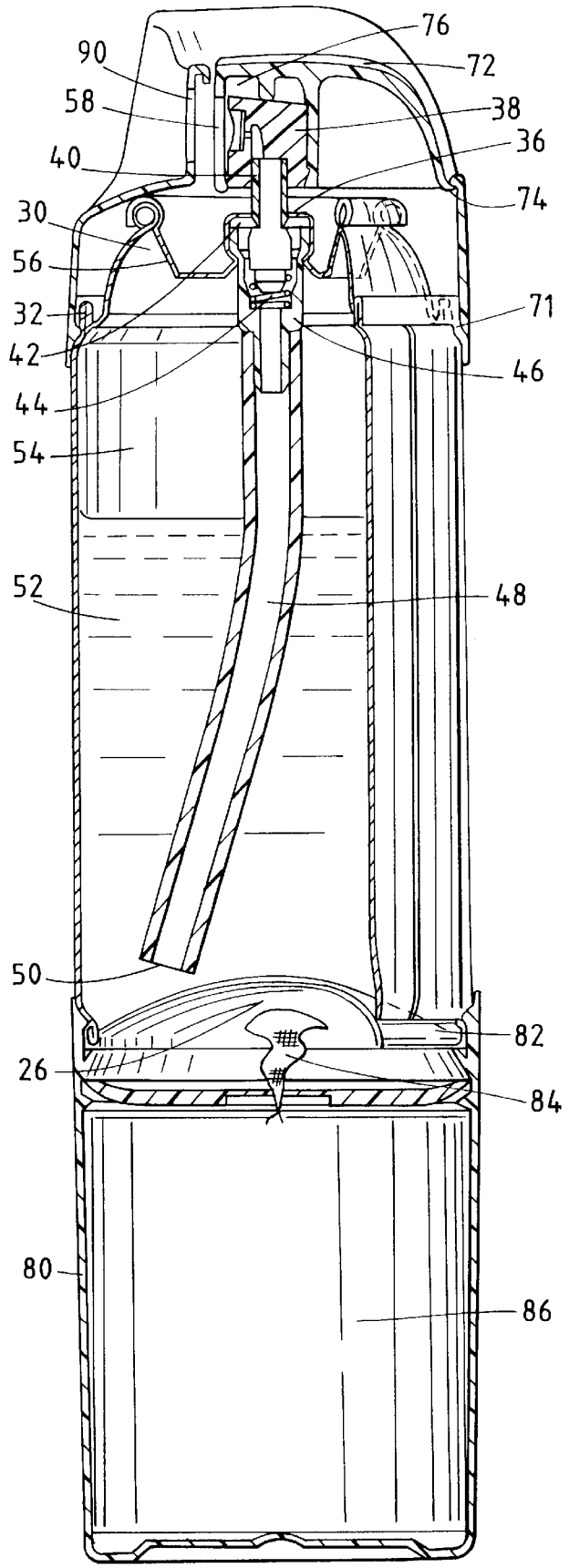
FIG. 3 is a cross-sectional side view of the aerosol dispensing system of FIG. 1.

FIGS. 1 through 3 illustrate a first embodiment of a novel aerosol dispensing system 20. The aerosol dispenser consists of a metal container or can 22 formed of a thin rectangular steel sheet which is rolled into a cylindrical shape and is welded along an elongated seam (not shown). Essentially the entire external surface of the resulting metal cylinder (other than the elongated welded seam, not shown) can be lithographed or printed with product and advertising content before being welded along the seam. The open top and open bottom are both of reduced diameter forming what is commonly known as a "necked-in" can. A concave metal can base 26 is crimped at its edge to form a bottom bead 28 or curl which forms a pressure seal. A metal top dome 30 is crimped at its edge to form a top bead 32 or curl to form a pressure seal. While the top bead 32 and bottom bead 28 are indented slightly from the cylindrical wall to produce a "necked-in" can, a conventional "straight-sided" can be formed if desired.

A valve assembly 36 is crimped to the top dome 30. The valve assembly 36 includes a valve button 38 which movably rests on a valve stem 40 which is fixedly secured within a housing 46. A gasket 42 is located beneath the valve stem, and a cylindrical spring 44 is tensioned upwardly against the gasket. At the bottom of the valve housing 46 is secured a hollow dip tube 48 which extends downwardly and has a bottom opening 50 near the can base 26.

The aerosol dispenser 20 is capable of holding a mixture of concentrate and liquid propellant 52 which is under pressure. The concentrate can be paint, insecticide, cleaning chemicals or the like. Vaporized propellant 54 is released into the space above the liquid propellant and concentrate 52, and creates downward pressure on the liquid propellant and concentrate 52.

The valve housing 46 is crimped to a metal carrier 56 which in turn is crimped to the top dome 30. The result is a sealed, pressurized container which retains the concentrate and liquid propellant until the valve assembly is activated for use. The gasket 42 prevents the flow of concentrate and liquid propellant by sealing the valve stem 40 at the orifice and the shoulder regions of the assembly.

When a user causes the button 38 to be depressed, the button moves downwardly against the tension of the spring 44. The gasket 42 flexes and exposes the orifice of the valve stem 40 to the interior of the dip tube 48. As a result, the mixture of concentrate and liquid propellant 52 is forced through the bottom opening 50 and upwardly through the hollow dip tube 48. The concentrate and liquid propellant are further mixed in the valve assembly 36 and forced through interior passages 58 in the button 38 and are released as an aerosol spray.

A plastic spray dome 70, which can be of one piece or two piece construction and formed of polypropylene material, is snap fit to the top of the metal can 22. The dome 70 forms a cap or cover which remains on the dispenser during use. A series of ridges 71 around the bottom of the dome snap fit over the necked-in bead 32 to retain the dome against the can 22. The dome 70 includes a trigger actuator 72 attached by a hinge 74 at its rear base to allow vertical movement of the trigger actuator 72. The trigger actuator 72 includes a bottom cup 76 which captures the button 38 and forces the button 38 downwardly as the trigger actuator 72 is depressed downwardly by the finger or thumb of the user. This opens the valve assembly 36 so that the aerosol spray escapes through a circular aperture 80 located in the spray dome 70.

While use of a spray dome 70 is generally preferred, the spray dome 70 can be eliminated and the user can directly depress the valve button 38 by the index finger or thumb. In such a system, a plastic cap (not illustrated) is snap fit over the top bead 32 to protect the button 38 from accidental depression during storage. The cap is removed by the user before use of the dispenser. Either version of the aerosol dispenser can be utilized with the present invention.

As shown in FIGS. 1–3, a bottom cup 80 is removably attached by snap fit to the bottom of can 22. Bottom cup 80 is preferably made of plastic, and may be of the same type of plastic as spray dome 70 or the top cap. The bottom cup 80 includes a series of ridges 82 for snap fitting the bottom cup 80 to the bottom bead 28 of can 22, in the same manner that spray dome 70 or a plastic cap is snap fitted to top bead 32.

An absorbent material 84 is placed in the bottom cup 80. In the embodiment shown in FIGS. 2 and 3, the absorbent material comprises wipes or towelettes formed into a roll 86. The towelettes may be paper, cloth or other suitable absorbent material, and the individual towelettes may be perforated to permit easy removal of one or more towelettes from the roll 86. As shown in FIG. 3, the roll 86 may be adapted to feed towelettes from the center of the roll 86. A cover 88 is provided to retain roll 86 in bottom cup 80. The cover 88 may be made of plastic. An aperture 90 is provided in the center of cover 88. The leading portion of the roll 86 of towelettes is pulled from the center of roll 86 up through aperture 90.

For shipping, sale and storage, bottom cup 80 is attached to can 22. When wipes are needed, the user removes bottom cup 80 from can 22 and pulls out absorbent material 84 as needed. The user may hold can 22 in one hand while holding bottom cup 80 in the other hand, and use the fingers of the hand holding can 22 to pull out towelettes from bottom cup 80. When use is completed, the user simply snap fits bottom cup 80 back on to the bottom of can 22. The leading end of the roll 86 fits inside convex base 26 of can 22 when bottom cup 80 is attached to can 22.

As shown in FIG. 4, cover 88 includes aperture 90 for dispensing wipers. Extending from aperture 90 are slits 92, which form a cross-shape. Such a configuration in combination with the resiliency of the plastic material provides some resistance when the user pulls on the end of the roll 86, so that only the desired number of towelettes may be pulled out, and permits the user to tear off the desired number of towelettes. Each slit 92 terminates in a small aperture 94 which helps prevent the slits from tearing when the plastic is flexed.

As shown in FIG. 5, bottom cup 80 includes tabs 100 spaced at locations around the perimeter of the top opening of bottom cup 80 for engaging and securing cover 88 in place. The cover 88 also includes finger openings 96. If the supply of absorbent material is depleted, cover 88 may be removed. The user inserts fingers in finger openings 96, removes cover 88 from cup 80 by flexing cover 88 slightly to disengage it from tabs 100, inserts a new roll 86 into bottom cup 80, and replaces cover 88 onto cup 80.

FIG. 6 provides a view of cover 88 removed from bottom cup 80. Notches 102 are provided in the perimeter of cover 88 to facilitate flexing of cover 88 for engaging or disengaging tabs 100 on bottom cup 80. The tabs 100 and notches 102 may also be designed so that cover 88 may be attached and removed by rotating cover 88 with respect to bottom cup 80 so that tabs 100 and notches 102 align, and rotating cover 88 so that tabs 100 and notches 102 do not align for securing cover 88 to bottom cup 80. FIG. 7 is a cross-sectional view of cover 88.

FIG. 8 is a detailed view of bottom cup 80 showing tabs 100 for engaging the perimeter of cover 88 and removably securing cover 88 to bottom cup 80. FIG. 8 also shows the series of ridges 82 on bottom cup 80 which provide a snap fit onto bottom bead 28 of can 22.

FIGS. 9 and 10 illustrate alternate embodiments of the wiper dispenser of the invention. In the embodiment of FIG. 9, there is no top cover, and the absorbent material 102 is simply pulled out from the center of the roll 104. The user may either removed the entire roll 104 from the cup 106, or leave the roll 104 in the cup 106 and pull out the desired amount of absorbent material 102. In this embodiment, the absorbent material may be, for example, a continuous elongated sheet of material or a series of towelettes connected by perforations as previously described.

A removable and disposable dust cover (not shown) may be provided to seal the absorbent material in the cup 106 for transportation, storage and sale. The dust cover may be made of paper or plastic film, and may be imprinted with product information. The user peels off the dust cover to access the absorbent material. When the supply of absorbent material is depleted, the user has at least two options. First, a new supply of absorbent material can be readily inserted into the open cup 106. Second, the user can discard the empty cup and purchase a new, sealed cup containing a fresh supply of absorbent material.

In the embodiment of FIG. 10, a cover 108 is provided with a single slit 110 through which absorbent material 102 is dispensed.

FIG. 11 illustrates yet another embodiment of the invention in which absorbent material 102 is dispensed from the bottom, rather than the top, of bottom cup 106. An aperture 112 is provided with a flexible cover 114. In this embodiment, the user need not remove bottom cup 106 from the aerosol can (not shown), but need only open cover 114 and pull out wipers as needed.

These illustrative embodiments can be modified to accommodate a variety of absorbent materials, e.g., paper or cloth in elongated sheets, towelettes connected by perforations, cotton balls, and other materials. The absorbent material may be dry or impregnated with a liquid such as a cleaning solution.

To avoid excessively long packages, the relative dimensions of the aerosol can and the wiper dispenser (the bottom cup) can be adjusted so that the length of the entire package is comparable to that of standard aerosol cans. This permits the novel can with on-board wiper dispenser to fit retail shelving and the user's storage facilities without modification to the shelves and storage units.

Further modifications and variations in the invention will be apparent to one of ordinary skill in the art.

What is claimed is:

1. An aerosol dispenser system comprising:

an aerosol container having a bottom and a top, and a wiper dispenser for containing and individually dispensing a plurality of absorbent wipes, the wiper dispenser being removably attached to the bottom of the container.

2. The aerosol dispenser of claim 1 wherein the wiper dispenser is a cup.

3. The aerosol dispenser of claim 2 wherein the cup is attached to the container by a snap fit.

4. The aerosol dispenser of claim 2 wherein the cup comprises a removable cover, the cover having an aperture through which the wipes are dispensed.

5. The aerosol dispenser of claim 1 wherein the absorbent wipes comprise a plurality of towelettes.

6. The aerosol dispenser of claim 5 wherein the towelettes are connected by perforations to form a roll.

7. The aerosol dispenser of claim 6 wherein the roll is adapted to feed towelettes from the center of the roll.

8. An aerosol dispenser system comprising:

a pressurized container of generally cylindrical shape having a top and a bottom;

a cup removably attached to the bottom of the container;

a roll of absorbent towelettes disposed in the cup; and a cover removably attached to the cup for retaining the roll of towelettes and having an aperture through which the towelettes are dispensed.

* * * * *